United States Patent [19]

Morrow

[11] 4,015,532

[45] Apr. 5, 1977

[54] ENERGY GENERATOR FOR ROTATING PROJECTILES

[75] Inventor: Warren P. Morrow, Silver Spring, Md.

[73] Assignee: The United States of America as represented by the Secretary of the Army, Washington, D.C.

[22] Filed: Feb. 11, 1976

[21] Appl. No.: 657,130

[52] U.S. Cl. ..... 102/70.2 GA; 102/70.2 R; 102/76 R

[51] Int. Cl.[2] ..... F42C 9/00; F42C 15/00

[58] Field of Search ..... 102/70.2 G, 70.2 GA, 102/70.2 R, 76 R, 82, 83

[56] References Cited

UNITED STATES PATENTS

| | | | |
|---|---|---|---|
| 2,486,362 | 10/1949 | O'Brien | 102/70.2 R |
| 2,710,578 | 6/1955 | Rabinow | 102/70.2 R |
| 2,872,538 | 2/1959 | McLean | 102/70.2 R |
| 3,976,011 | 8/1976 | Crescas et al. | 102/70.2 R |

*Primary Examiner*—Charles T. Jordan
*Attorney, Agent, or Firm*—Nathan Edelberg; Robert P. Gibson; Saul Elbaum

[57] ABSTRACT

An energy generator for rotating projectiles which may be adapted to produce either electrical or mechanical energy. An armature in the form of a rotatable disc is offset from the spin axis of the projectile towards the outer periphery thereof. The disc is normally biased in a first position and is caused by virtue of a mass delivery mechanism actuated by centrifugal forces, to rotate to a second position. The mass delivery mechanism provides masses in the form of weighted balls to a slot formed in the outer periphery of the disc and the centrifugal force rotates the disc to its second position. An outlet chute is adapted to receive the weighted ball whereupon the disc rerotates to its first position. The oscillatory motion of the armature may be utilized to couple out either the electrical or mechanical energy.

10 Claims, 7 Drawing Figures

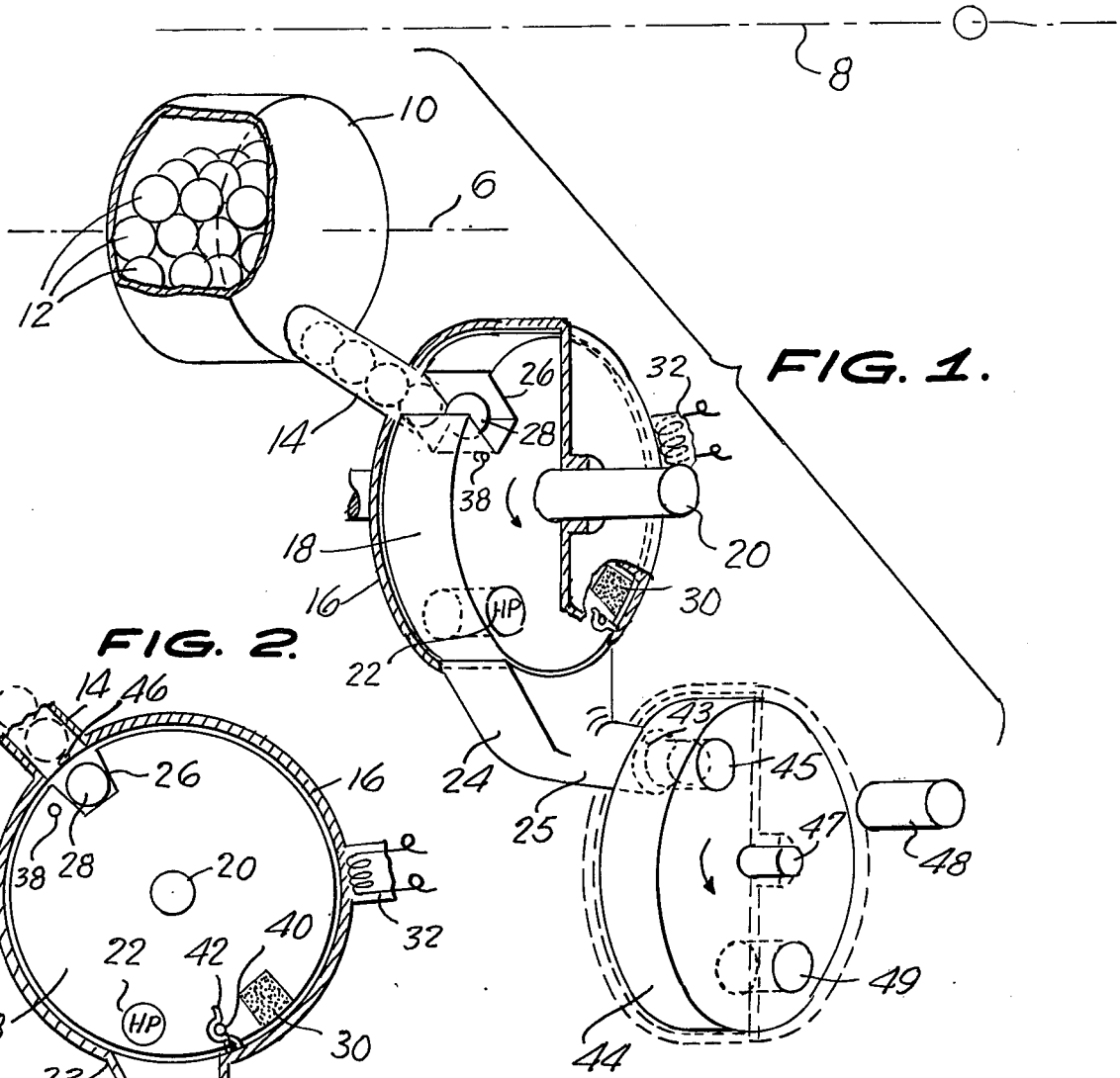
FIG. 1.
FIG. 2.
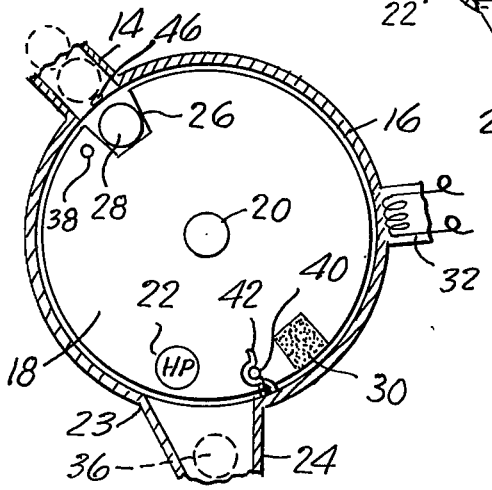
FIG. 3.
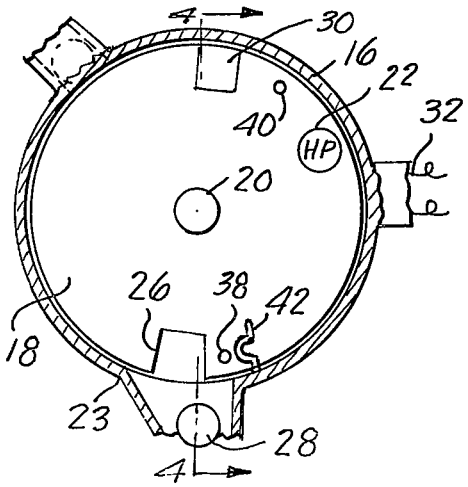
FIG. 4.
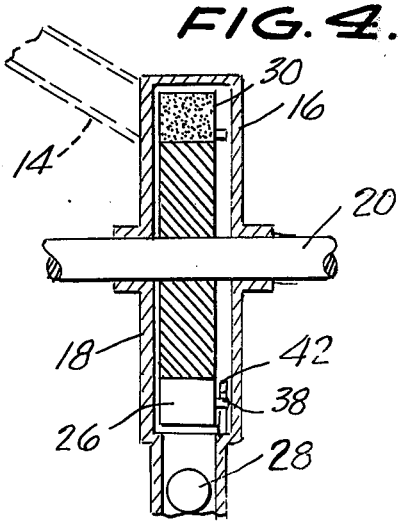

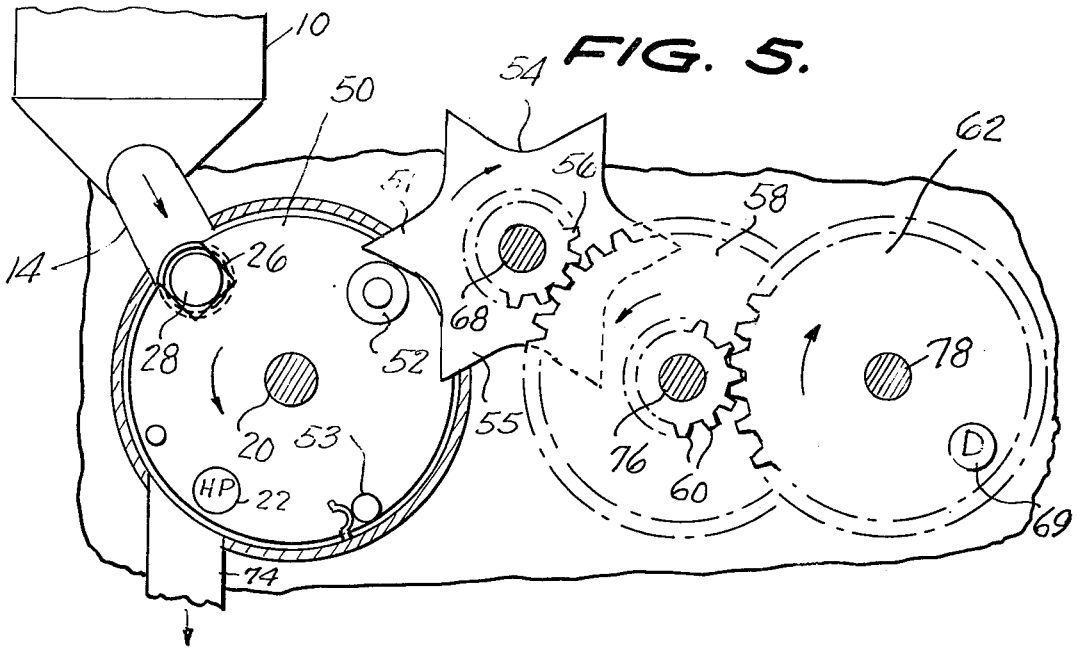
FIG. 5.
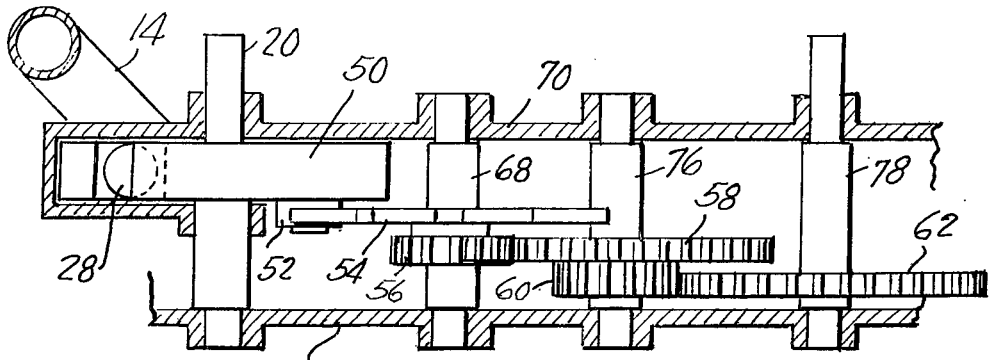
FIG. 6.
FIG. 7.
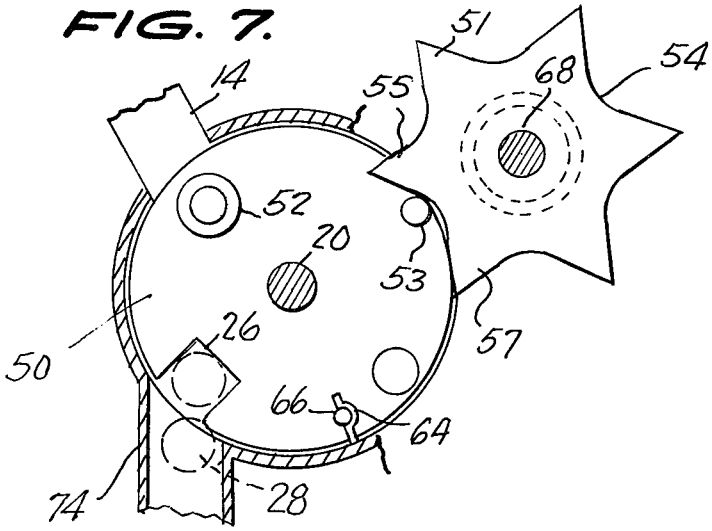

ENERGY GENERATOR FOR ROTATING PROJECTILES

RIGHTS OF THE GOVERNMENT

The invention described herein may be manufactured, used and licensed by or for the United States Government for governmental purposes without the payment to me of any royalty thereon.

BACKGROUND OF THE INVENTION

1. Field of the Invention

The present invention is related to energy generation devices and, more particularly, is directed to a device for producing either mechanical or electrical energy in a rotating projectile.

2. Description of the Prior Art

Many projectiles in the ordnance field have substantially high spin rates associated therewith. Many of such projectiles are utilized in conjunction with fuzing devices that control the detonation of the explosive carried by the projectile and such high spin rates lead to certain advantages and disadvantages.

One of the advantages is that the spin of the projectile is positive evidence of the launching or firing thereof, and therefore may be utilized as a safety signature. In other words, the high centrifugal forces generated by a properly launched rotating projectile are utilized to shift mechanical components, such as springs, pawls, and the like, into proper position in order that the remainder of the functions may be properly effectuated. On the other hand, if the requisite high spin forces are not generated, as is well known in the art, the mechanical components will not be properly actuated such that the fuzing device will be inoperative.

A disadvantage of the high spin forces associated with rotating projectiles is that the clock mechanisms utilized in the fuzing devices must necessarily undergo and be able to withstand the extremely high centrifugal forces associated therewith. This requires careful, painstaking design of such clock mechanisms and failure to withstand the high G forces can lead to premature detonation or a dud.

Thus, while the spin forces are known to provide positive safety functions, they act detrimentally to the timing function of a spinning projectile and can often lead to the downfall of the entire fuzing device. It may therefore be appreciated that it would be extremely advantageous if an inexpensive design could be devised of a device which would enable the spin of such projectiles to be directly utilized in a timing function that would enable the prior art clock mechanisms to be dispensed with. The timing function could then, in turn, be utilized to generate either electrical or mechanical energy as desired.

A further disadvantage of the common prior art clock mechanisms utilized in many of the fuzing devices is that of obsolescence. Many of the watch parts, such as gears, pinions, ratchets, verge mechanisms, and the like utilized in the past, are not readily available as partly a result of the general shifting of the watch industry to electronic devices. While electronic timers are being utilized, they are subject to their own infirmities, such as reliability, cost and the like. Further, electronic timers, just as their mechanical predecessors, must also be designed to withstand the high spin forces generated by a rotating projectile.

If the rotational movement of the spinning projectile could further be utilized to generate either electrical or mechanical energy, such could be further advantageously utilized to eliminate the bulky, expensive, and unreliable battery components which must accompany any electrically operated fuzing component.

Thus, it can be appreciated that a myriad of advantages would accrue as a result of a device which could provide timing functions, as well as energy generation, by directly utilizing the high centrifugal forces generated by a spinning projectile after launch.

OBJECTS AND SUMMARY OF THE INVENTION

It is therefore a primary object of the present invention to provide a unique and novel device which enables the generation of energy as a direct result of the spin forces generated by a rotating projectile.

Another object of the present invention is to provide a simple and inexpensive device which may be incorporated into existing projectile designs and which depends for actuation only upon the high spin rate of the projectile, and which, when actuated, provides timing and energy generation functions, as desired.

An additional object of the present invention is to provide an inexpensive and reliable timing device which does not rely for its operation upon traditional clock mechanisms such as gears, pinions, teeth, ratchets, and the like, but which, in contradistinction, relies only upon the centrifugal forces generated during the high spinning of a rotating projectile.

A still further object of the present invention is to provide a timing apparatus mountable within a rotating projectile which provides oscillatory motion directly in response to the high centrifugal forces generated during the spinning of the projectile.

The foregoing and other objects are attained in accordance with one aspect of the present invention through the provision of an apparatus mounted within a rotating projectile, which rotating projectile has a main spin axis. The apparatus comprises an armature having a pivot axis which is displaced from the main spin axis of the projectile. The armature includes means, preferably in the form of a weight, for normally biasing the armature in a first position. Means are provided for overcoming the biasing means for rotating the armature about its pivot axis to a second position. The apparatus further includes means coupled to the armature for generating energy when the armature is between its first and second positions. The weight is provided on the outer periphery of the armature and is further utilized to cause same to rotate from its second position back to its first position.

It accordance with other aspects of the present invention, the means for overcoming the force of the biasing means preferably comprises weighted means removably positionable near the periphery of the armature at a position spaced from the position at which biased weight is affixed. The apparatus further comprises means for storing a plurality of masses, means for delivering the masses one-by-one to the armature, and means for receiving the masses one-by-one from the armature. In a preferred form, the armature comprises a disc having a mass-receiving slot peripherally formed thereon which is located, when the disc is positioned in its first position, adjacent the mass delivery means, and which, when the disc is positioned in its second position, is located adjacent the mass receiving means.

In accordance with still other aspects of the present invention, the means for generating energy comprises a magnet fixedly positioned on the periphery of the armature disc, and a pickup coil which is fixedly mounted externally of the armature disc. When the disc rotates between its first and second positions, the magnet is caused to pass adjacent the coil whereupon a pulse of electrical energy is developed therein. Alternatively, the means for generating energy may comprise a star wheel coupled to be rotated by a pair of actuation pins positioned upon the armature disc, which latter element is this event may be properly designated as a verge wheel. The rotation of the star wheel may be coupled to an output energy utilization device via a gear train, as desired.

In accordance with another aspect of the present invention, the masses when delivered from the armature disc into the mass receiving means may be further utilized in, for example, a rotor to rotate same about another rotatable axis in order to, for example, align other mechanical or electrical components for other functions.

BRIEF DESCRIPTION OF THE DRAWINGS

Various objects, aspects, uses and advantages of the present invention will be more fully appreciated as the same becomes better understood in the following detailed description of the present invention viewed in conjunction with the accompanying drawings, in which:

FIG. 1 is a perspective view schematically illustrating the main components comprising a preferred embodiment of the present invention, shown partially cut away for clarity;

FIG. 2 is a side view of the armature element of the preferred embodiment illustrated in FIG. 1 in a first position;

FIG. 3 is a view of the armature element similar to that shown in FIG. 2 but in a second position;

FIG. 4 is a sectional view of the armature element shown in FIG. 3 and taken along line 4—4 thereof;

FIG. 5 is a plan view of the main component of a second preferred embodiment of the present invention;

FIG. 6 is a side view of the components illustrated in the preferred embodiment of FIG. 5; and FIG. 7 illustrates the position of the armature disc of the second preferred embodiment shown in FIG. 5 but in a different operative position thereof.

DETAILED DESCRIPTION OF THE PREFERRED EMBODIMENTS

Referring now to the drawings, wherein like reference numerals designate identical or corresponding parts throughout the several views, and more particularly to FIG. 1 thereof, there is illustrated a first preferred embodiment of the present invention. Reference numeral 8 designates schematically the position of the center line of the projectile about which the preferred embodiment of FIG. 1 rotates as a connected unit when a projectile in which it is housed is spinning after being launched or fired. In other words, the center line 8 represents the main rotational spin axis of the projectile.

Rotatable about axis 8 when the projectile (not shown) in which they are housed is rotating are three basic components: reservoir 10, armature 18, and rotor 44. These units are interconnected and fixedly mounted within the projectile in a particular spatial relationship which remains unaltered with respect to the distance of each component from center line 8. For proper operation, as will become more clear hereinafter, the pivot axis 20 of armature 18 must be farther away from center line 8 of the projectile than is the axis 6 of ball reservoir 10. Further, the axis of conduit 25 must be outwardly disposed from axis 20.

Reservoir 10 is seen to serve as housing for a plurality of weighted masses in the form of similarly sized balls 12. Balls 12 are loosely packed within the reservoir so as to be freely movable within an opening formed in the lower portion of reservoir 10 to be fed to conduit 14.

Armature 18 comprises a disc having a ball-receiving slot 26 located on the outer periphery thereof. In the position illustrated in FIG. 1, ball-receiving slot 26 is positioned adjacent the opening from inlet conduit 14 for receiving a ball 28 therein.

Positioned peripherally on the opposite side of slot 26 is a permanent magnet 30 affixed to the outer periphery of armature disc 18. Counter clockwise from magnet 30 is positioned a weight 22 on the periphery of armature disc 18. Prior to the time a ball 28 is positioned within slot 26, heavy point 22 is positionable, by virtue of centrifugal forces, at the outermost point of housing 16 with respect to the center line 8 of the projectile. This outermost point is indicated generally by the reference numeral 23 in FIG. 2 and is located in the vicinity of an outlet conduit 24.

Armature disc 18 further includes a clockwise stop pin 40, a counter clockwise stop pin 38, and a stop member 42, pin 38 serving to limit the counter clockwise rotation of disc 18 while pin 40 serves to limit the clockwise rotation thereof, both abutting stop 42 in their extreme respective rotational movement (FIGS. 2 and 3).

Positioned on the outer periphery of the housing 16 of armature disc 18 is a pickup coil 32 which is strategically positionable such that magnet 30 must pass closely adjacent thereto when armature disc 18 moves from its first or normal position illustrated in FIG. 2 to its second position illustrated in FIG. 3, and vice-versa.

As mentioned hereinabove, located in the vicinity of the extreme peripheral portion 23 of housing 16 with respect to center line 8 is an outlet conduit 24 for receiving previous ball 36 released from slot 26 when in the position illustrated in FIG. 3. Outlet conduit 24 includes a forwardly facing portion 25 through which the ball may be delivered to, for example, a further rotor member 44.

Rotor 44 comprises an optional element and is schematically illustrated as having an axis of rotation 47, a ball receiving slot 45, a tetryl lead 48, and a bore or opening 49. The outlet opening 43 from portion 25 of outlet conduit 24 is preferably controllable so as to permit selective escapement of balls therethrough to ball receiving slot 45 of rotor 44.

Inlet conduit 14 preferably includes a gate member 46 schematically illustrated, which normally closes off conduit 14 so as to prevent ball 12 from entering slot 26. Gate 46 may be setback-actuated or air actuated in order to insure its displacement only upon the firing of the projectile to begin releasing ball 12 into slot 26.

In operation, prior to the time gate 46 is removed, but after the projectile has been launched and is spinning about its center line 8, the heavy point or weight 22 of armature 18 will cause the latter to be positioned substantially as shown in FIG. 2, with the weight 22 in the vicinity of the outer peripheral portion 23 of projectile axis 8 prior to the time a ball 28 has been inserted in slot 26. When gate 46 is removed, as by setback forces, ram air or the like, a single weighted mass or ball 28 is released to rest within slot 26. By judicious selection of the masses, the position represented by slot 26 then becomes heavier than that of weight 22 whereby the armature 18 begins to rotate counter clockwise as viewed in FIG. 2 to the position illustrated in FIG. 3 where slot 26 rests in the vicinity of the outer peripheral portion 23 of the projectile.

In this position, further movement is inhibited by the abutment of pin 38 against stop member 42 and mass or ball 28 is released through conduit 24. Magnet 30 has rotated past coil 32 so as to generate a pulse of electrical energy, and further balls are stored within conduit 14. When ball 28 is released from slot 26 as illustrated in FIG. 3, the weight 22 on the outer periphery of armature disc 18 again becomes the heaviest point of the disc. This, in turn, causes re-rotation of disc 18 about pivot point 20 in a clockwise direction until the first position illustrated in FIG. 2 is reobtained. Movement from the second position back to the first position also causes magnet 30 to bypass pickup coil 32 whereby another pulse of electrical energy is generated. Further, movement back to the position illustrated in FIG. 2 disposes slot 26 so as to receive the ball therein. The cycle is then repeated so long as balls are supplied to slot 26.

Coil 32 may be coupled to any convenient form of output utilization device such as a capacitor to charge same for later use. With careful design of components, enough energy may be generated in order to replace or supplement presently existing battery power supplies for electronic functions. The available energy from the present invention will depend upon the diameter and rate of rotation of the projectile, the dimension and mass of the armature, and the like.

Centrifugal forces act to force the balls 12 through the conduit 14 and through the conduit 24. Portion 25 of conduit 24 faces forwardly and after acceleration of the projectile ceases, creep forces assist in moving the ball forwardly within part 25 to, for example, a ball receiving slot 45 of rotor 44. It should be understood that the form of utilization device at the outlet of portion 25 is optional and is illustrated as a rotor 44 for the sake of convenience and ease of understanding. The ball within slot 45 may be utilized to align aperture 49 with a tetryl lead 48 in the explosive train of the fuzing device, for example. The balls expelled from opening 43 of conduit 25 could move other mechanisms as desired.

Referring now to FIGS. 5 through 7, an alternative preferred embodiment of the present invention is illustrated. In this form, armature disc 18 comprises a verge wheel 50 having a pair of actuation pins 52 and 53 spaced and upwardly extending on one surface thereof. Verge wheel 50 is still adapted to be rotatable about its axis 20 and has a weight 22 and slot 26 formed therein as in the first embodiment. Verge wheel 50 is also adapted to be moved between basic positions illustrated in FIGS. 5 and 7, respectively, and in so doing, pins 52 and 53 act on the pointed edges of a star wheel 54 to cause clockwise rotation thereof.

Star wheel 54 has a pinion 56 and is rotatable about its axis 68 in a clockwise sense. Pinion 56 is coupled to a wheel 58 by a gear train on the periphery thereof to cause counter clockwise rotation about its axis 76 and concomitant rotation of its pinion 60.

Pinion 60 is coupled to wheel 62 via a gear train formed on the outer periphery thereof and causes wheel 62 to rotate slowly about its axis 78 which may, for example, bring a detonator 69 in line with other explosive train components.

In operation, verge wheel 50 is illustrated in its first ball-receiving position in FIG. 5 wherein actuating pin 52 rests against adjacent shoulder of point 51 of star wheel 54 as illustrated. When ball 28 is received within slot 26 to cause verge wheel 50 to rotate counter clockwise to the position illustrated in FIG. 7, actuator pin 53 coacts with point 55 of star wheel 54 to rotate same to the position illustrated in FIG. 7.

Release of ball 28 as illustrated in FIG. 7 again causes re-rotation of verge wheel 50 to the position illustrated in FIG. 5, thereby causing pin 52 to further engage point 55 of star wheel 54 in order to bring point 57 into proper position for the next counter clockwise rotation of verge wheel 50. A limit pin 66 and stop 64 are also provided in this embodiment, as is a ball-receiving conduit 74. As in the first embodiment illustrated in FIGS. 1 through 4, other utilization devices may be coupled to the outlet of the ball-receiving conduit 74, as desired. As viewed in FIG. 6 the entire gear train may be housed within a top plate 70 and a bottom plate 72, axes 20, 68, 76 and 78 being journaled for rotation therein.

Numerous variations and modifications are possible in light of the above teachings. It is therefore to be understood that within the scope of the appended claims the invention may be practiced otherwise than as specifically described herein.

I claim as my invention:

1. Apparatus mounted within a rotating projectile having a main spin axis, which comprises:
   rotor means having a pivot axis displaced from said main spin axis, said rotor means including means for normally biasing same in a first position
   means overcoming said biasing means for rotating said rotor means about said pivot axis to a second position; and
   means coupled to said rotor means for generating energy when said rotor means moves between said first position and said second position.

2. The apparatus as set forth in claim 1, wherein said biasing means comprises first weighted means fixedly positioned near the periphery of said rotor means.

3. The apparatus as set forth in claim 2 wherein said first weighted means further causes said rotor means to rotate from said second position back to said first position.

4. The apparatus as set forth in claim 3 wherein said means overcoming said biasing means comprises second weighted means removably positionable near the periphery of said rotor means at a position spaced from the position at which said first weighted means is fixed.

5. The apparatus as set forth in claim 4 wherein said apparatus further comprises means for storing a plurality of masses, means for delivering said masses one-by-one to said rotor means, and means for receiving said masses one-by-one from said rotor means.

6. The apparatus as set forth in claim 5 wherein said rotor means comprises a disc rotatable about said pivot axis and having a mass-receiving slot peripherally formed thereon which is located, when said rotor means is positioned in said first position adjacent said mass delivering means and which, when said rotor means is positioned in said second position, is located adjacent said mass receiving means.

7. The apparatus as set forth in claim 6, wherein said means for generating energy comprises a magnet fixedly positioned on the periphery of said disc and a coil fixedly mounted externally of said disc whereby said magnet is caused to pass adjacent said coil when said disc moves between said first and second positions to generate a pulse of electrical energy.

8. The apparatus as set forth in claim 7, further comprising second rotor means coupled to said mass receiving means for receiving said masses therefrom and for rotating about a third axis in response thereto.

9. The apparatus as set forth in claim 6, wherein said disc comprises a verge wheel having a pair of actuation pins spaced thereon and projecting from a surface thereof.

10. The apparatus as set forth in claim 9 wherein said means for generating energy comprises a star wheel coupled to be rotated by said actuation pins of said verge wheel, the rotation of said star wheel being coupled to an output energy utilization device via gear train means.

* * * * *